US008506111B2

(12) United States Patent
Woods

(10) Patent No.: US 8,506,111 B2
(45) Date of Patent: Aug. 13, 2013

(54) ILLUMINATION DEVICE WITH INTEGRATED CLAMP

(76) Inventor: Waihiem R Woods, Rochester Hills, MI (US)

( * ) Notice: Subject to any disclaimer, the term of this patent is extended or adjusted under 35 U.S.C. 154(b) by 99 days.

(21) Appl. No.: 13/290,531

(22) Filed: Nov. 7, 2011

(65) Prior Publication Data

US 2012/0327644 A1 Dec. 27, 2012

Related U.S. Application Data

(60) Provisional application No. 61/500,675, filed on Jun. 24, 2011.

(51) Int. Cl.
*F21L 4/00* (2006.01)

(52) U.S. Cl.
USPC ..... 362/191; 362/217.12; 362/220; 362/190; 362/199

(58) Field of Classification Search
CPC ..... F21L 4/00; F21V 21/08; F21V 21/145
USPC ..... 362/191.01, 217.12, 220, 190, 199
See application file for complete search history.

(56) References Cited

U.S. PATENT DOCUMENTS

| | | | | |
|---|---|---|---|---|
| 2009/0154161 | A1* | 6/2009 | Parker et al. | 362/249.05 |
| 2010/0008082 | A1* | 1/2010 | Brass et al. | 362/202 |
| 2010/0091483 | A1* | 4/2010 | Henry et al. | 362/191 |
| 2011/0222274 | A1* | 9/2011 | Ko et al. | 362/191 |
| 2012/0182727 | A1* | 7/2012 | Sharrah et al. | 362/190 |

* cited by examiner

*Primary Examiner* — Tracie Y Green
(74) *Attorney, Agent, or Firm* — Sinorica, LLC

(57) ABSTRACT

An illumination device with an integrated adjustable articulating clamp that pivots about a hinge on the opposite end of the device. The clamp is used for the purpose of affixing the illumination device to stationary objects to allow a user to perform actions using both hands without having the hold onto the illuminating device. The clamp folds into a slot in the housing of the illumination device when not in use and allows the user to wield the illuminating device like a regular flashlight. Battery compartments are located on both sides of the slot inside the housing of the illuminating device.

10 Claims, 8 Drawing Sheets

ILLUMINATION DEVICE WITH INTEGRATED CLAMP

The current application claims a priority to the U.S. Provisional Patent application Ser. No. 61/500,675 filed on Jun. 24, 2011.

FIELD OF THE INVENTION

The present invention relates generally to an apparatus for a portable light source. More specifically, it is a portable LED flashlight with an adjustable clamp, thereby providing the user freedom to use both his/her hands.

BACKGROUND OF THE INVENTION

We often forget the range of activities and tasks we have to perform with our two hands, like carrying a flashlight in one hand and trying to carry out a task with the other hand. The aforementioned situation occurs more often than not and can either be a minor annoyance to a serious occupational hazard. This is a constant problem with small portable flashlights. From the weekend do-it-yourselfer to the everyday job of being a maintenance worker, the flashlight is an invaluable tool utilized by both hobbyists and professionals. The present invention serves to assist users in providing a portable hand-held illuminating device that can attach to a stationary object so the user may be able to use said invention hands-free while completing a task with both hands. A mechanic working under the hood of a vehicle needing light can clamp the flashlight on the hood. An HVAC technician performing maintenance on a furnace will fully utilize the function and appreciate the present invention's effectiveness. An electrician will also appreciate the present invention when working on a breaker panel to try and restore power. Alternatively, the user can clamp the flashlight to the headboard of a bed to provide light for reading. The present invention takes the original flashlight and improves it to a whole new level.

SUMMARY OF THE INVENTION

It is an aspect of the present invention to provide an illumination device with integrated clamp that can be attached to stationary objects via a built-in clamp.

The present disclosure overcomes disadvantages of regular flashlights by providing a novel illumination device with integrated clamp that can be affixed to an object.

It is a further aspect of the present invention to provide an illumination device with integrated clamp that includes a light emitting component, a switch, a housing component, a clamp, a plurality of battery compartments. The light emitting component and the housing component being cylindrical in shape and are attached to each other via threads.

In accordance with a first aspect of the present invention, a novel illumination device with integrated clamp is provided. The novel illumination device with integrated clamp includes a light emitting component; a switch; a housing component; a clamp; a plurality of battery components with the clamp being able to pivot about a pivot point located at one end of the housing component. The clamp having enough resistance at the pivot point to keep the flashlight stationary. The clamp having enough force to clamp onto an object. A recessed slot to house the clamp when not in use.

In accordance with yet a further aspect of the present invention, illumination device with integrated clamp is provided. The illumination device with integrated clamp includes a light emitting component; a switch; a housing component; a clamp; a plurality of battery components with the clamp being able to pivot about a pivot point located at one end of the housing component. The clamp having enough resistance at the pivot point to keep the flashlight stationary. The clamp having enough force to clamp onto an object. A recessed slot to house the clamp when not in use.

DETAIL DESCRIPTIONS OF THE INVENTION

All illustrations of the drawings are for the purpose of describing selected versions of the present invention and are not intended to limit the scope of the present invention.

The present invention helps a user clamp a flashlight to an object, freeing his/her hands from holding the flashlight. Having both hands available for use, the user can proceed with secondary tasks.

Figure 1:
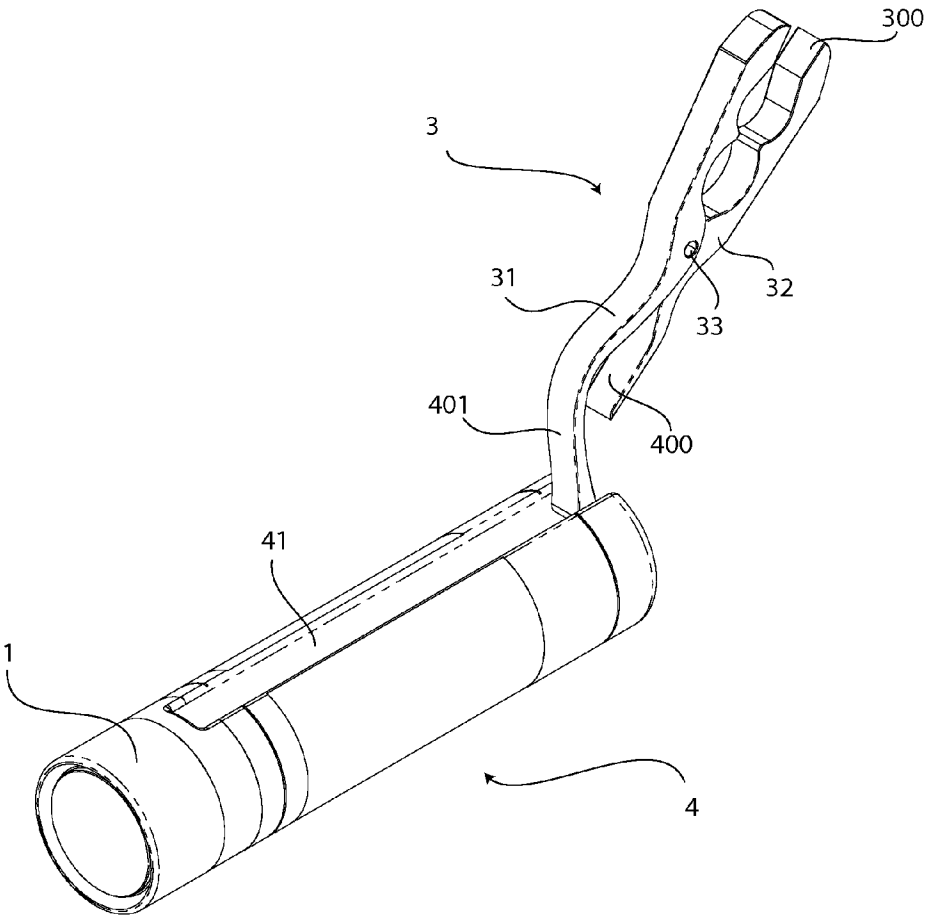
FIG. 1 is a perspective view of the present invention with the clamp pivoted outside the housing component.
Figure 2:
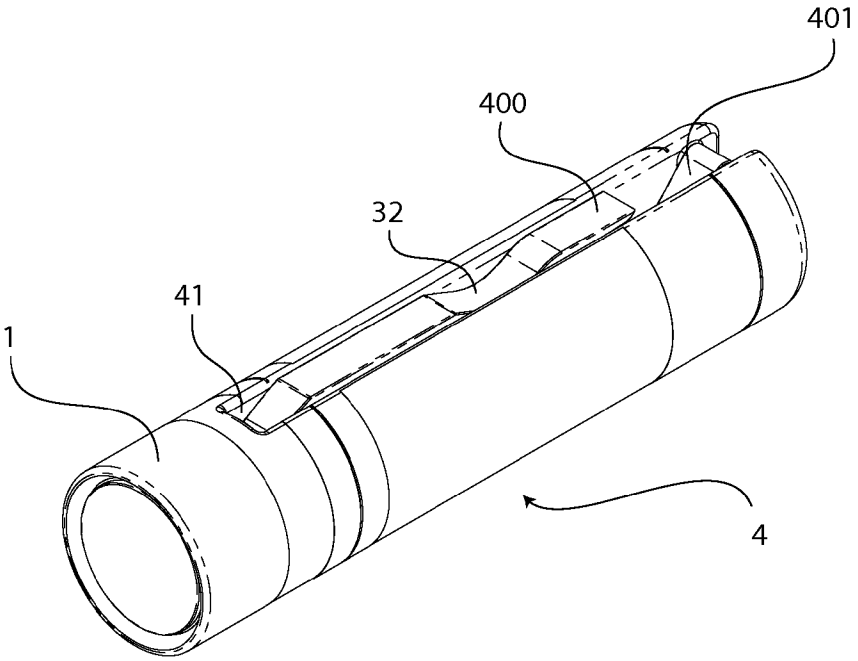
FIG. 2 is a perspective view of the present invention with the clamp resting in the recessed slot of the housing component.

In reference to FIG. 1, the present invention is shown and comprises a light emitting component 1, a housing component 4, and a clamp 3. The housing component 4 has a cylindrical shape and further comprises a recessed slot 41 to fit the clamp 3. The clamp 3 further comprises a first arm 31 and a second arm 32 with the first arm 31 and second arm 32 having a means to pivotally connect 33. The first arm 31 further comprises a grip end 300 and an elongated handle end 401 and the second arm 32 further comprises a grip end 300 and a handle end 400. The elongated handle end 401 of the first arm 31 pivotally connects to the housing component 4. The light emitting component 1 attaches to the housing component 4 via screw-like threads. In reference to FIG. 2, a switch 2 is shown and located on the housing component 4. Although the switch 2 is shown on the housing component 4, the switch 2 may be placed on the light emitting component 4 as well. The switch 2 is in the form of a push button where the user turns on and off the light by pushing the button; different forms of a switch may be used. The clamp 3 has a strong resistance against change in position to be able to direct the flashlight in the intended direction. The jaws of the clamp 3 will be able to fully open no less than 1.75" wide. A torsion spring 34 acting on the two arms of the clamp 3 at the pivotal connection point provides a strong clamping force. The torsion spring 34 provides resistive force for clamping. However, any device that can create tension between the first arm and the second arm such as tension springs, compression springs, and coil springs can be substituted. The clamp 3 is coated in a material such as but not limited to rubber.

Figure 3:
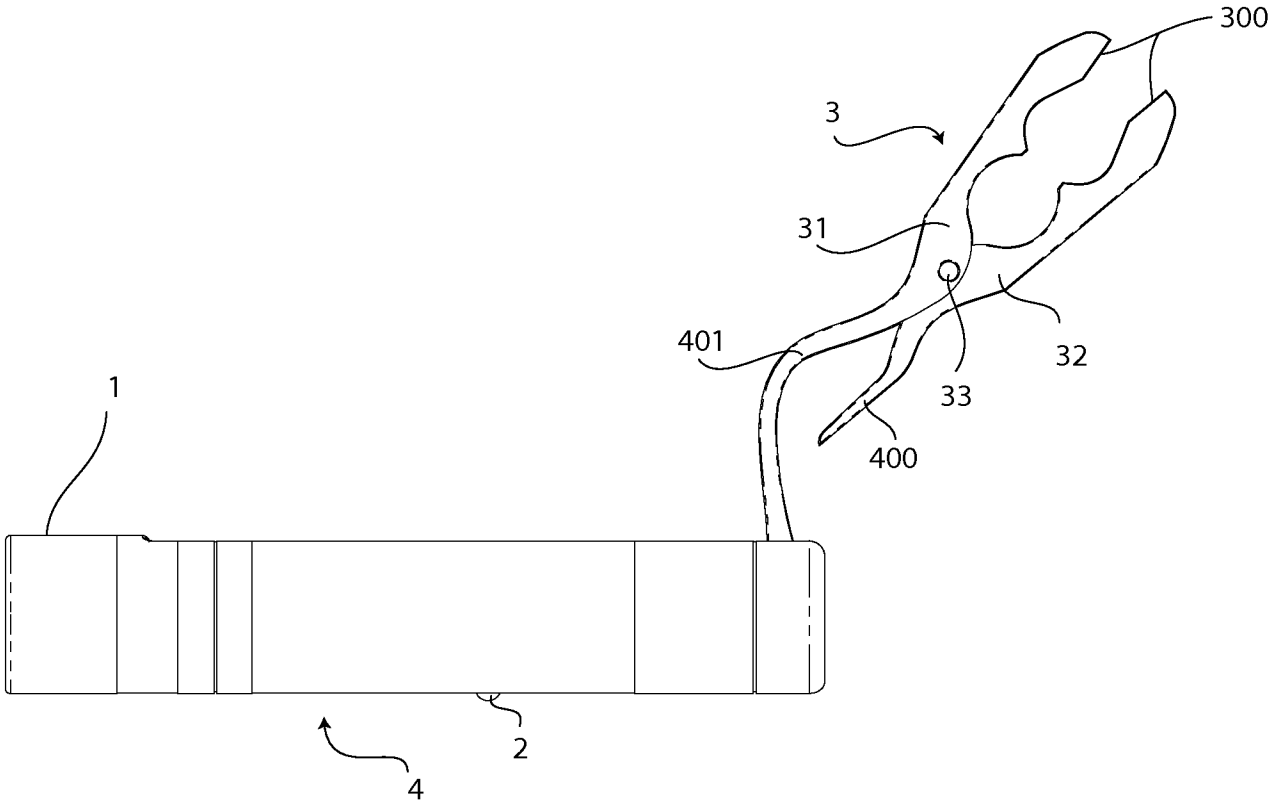
FIG. 3 is a right-side elevational view of the present invention with the clamp pivoted outside the housing component.
Figure 5:
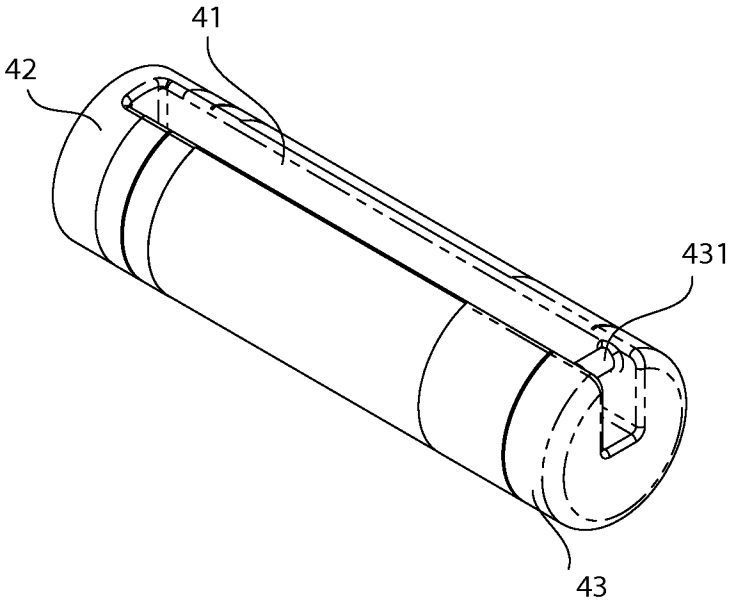
FIG. 5 is a back perspective view of the housing component of the present invention.
Figure 4:
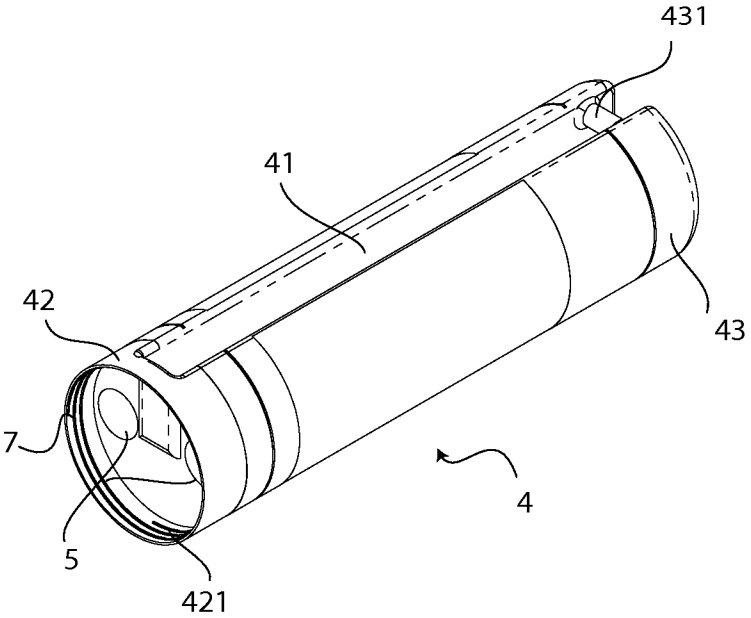
FIG. 4 is a front perspective view of the housing component of the present invention.
Figure 7:
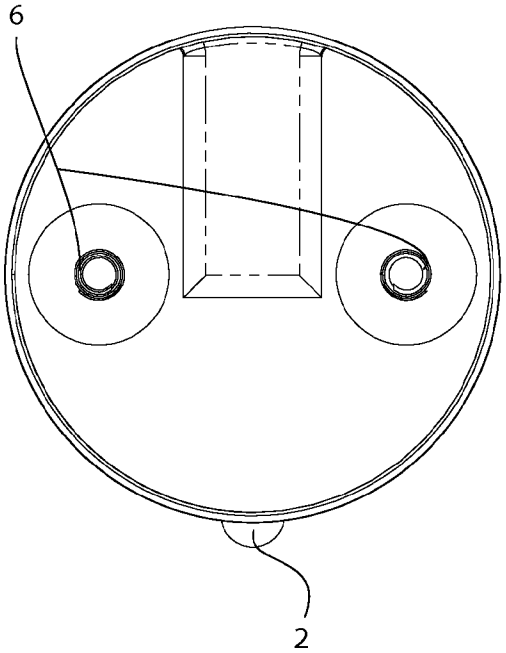
FIG. 7 is a front elevational view of the housing component of the present invention.
Figure 6:
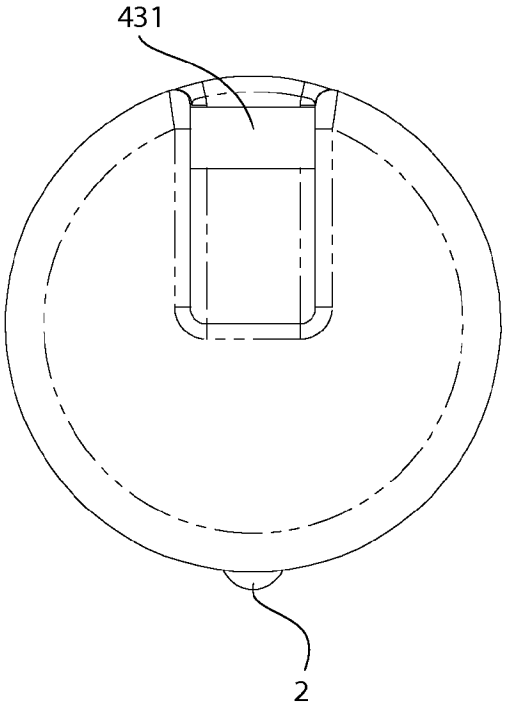
FIG. 6 is a rear elevational view of the housing component of the present invention.
Figure 8:
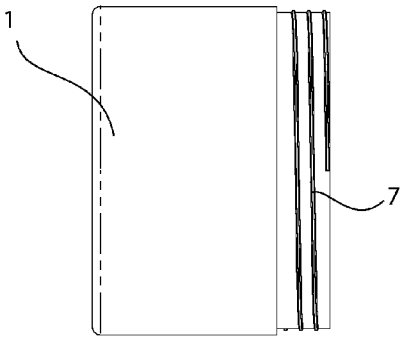
FIG. 8 is a right-side elevational view of the light-emitting component of the present invention.
Figure 10:
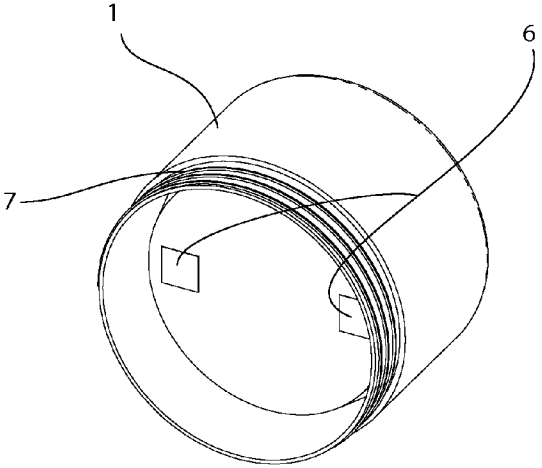
FIG. 10 is a rear perspective view of the light-emitting component of the present invention.
Figure 9:
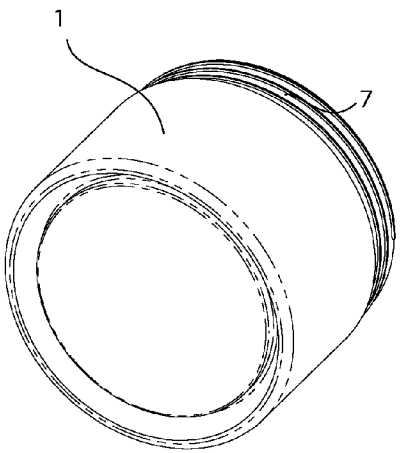
FIG. 9 is a front perspective view of the light-emitting component of the present invention.
Figure 11:
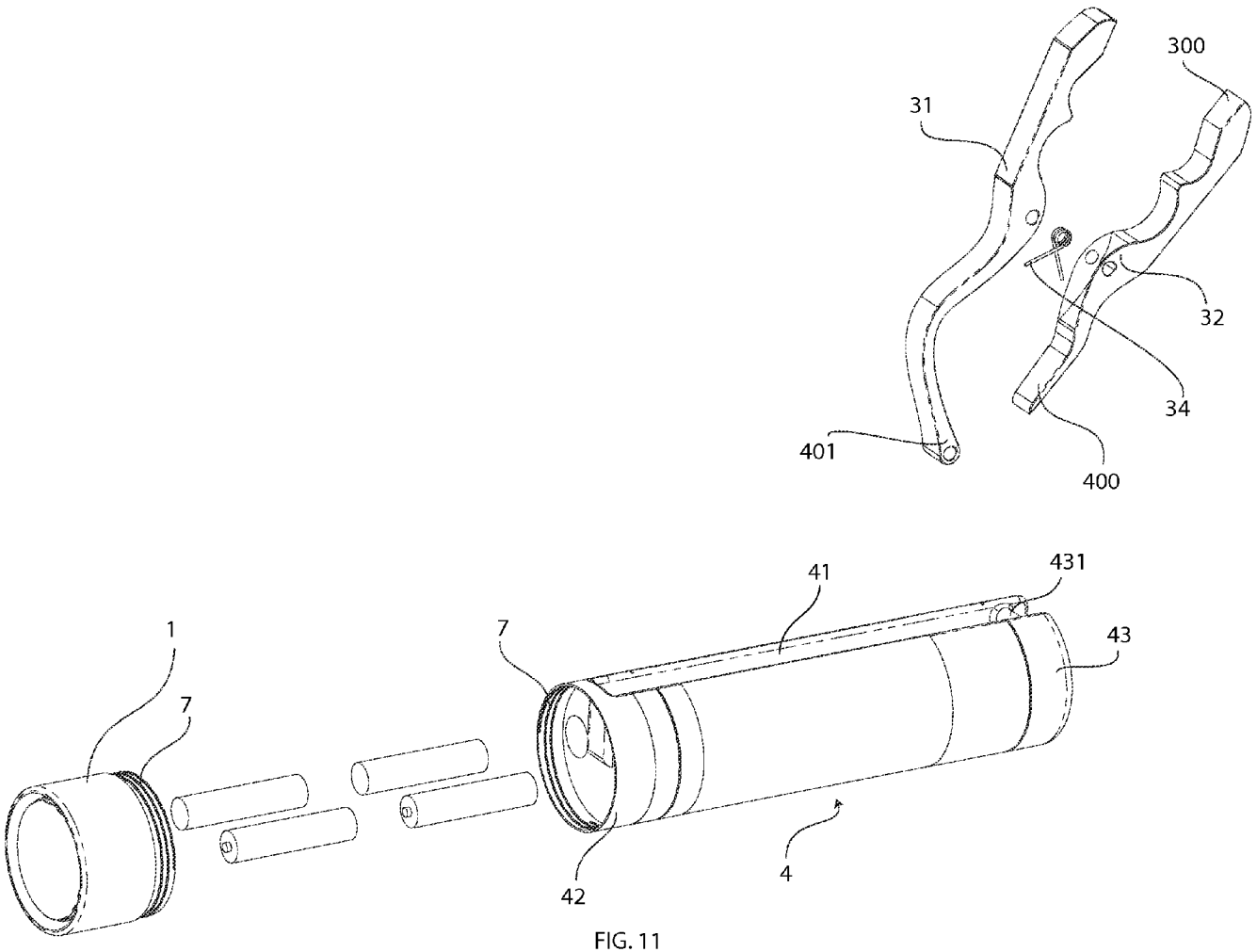
FIG. 11 is an exploded view of the present invention.
Figure 12:
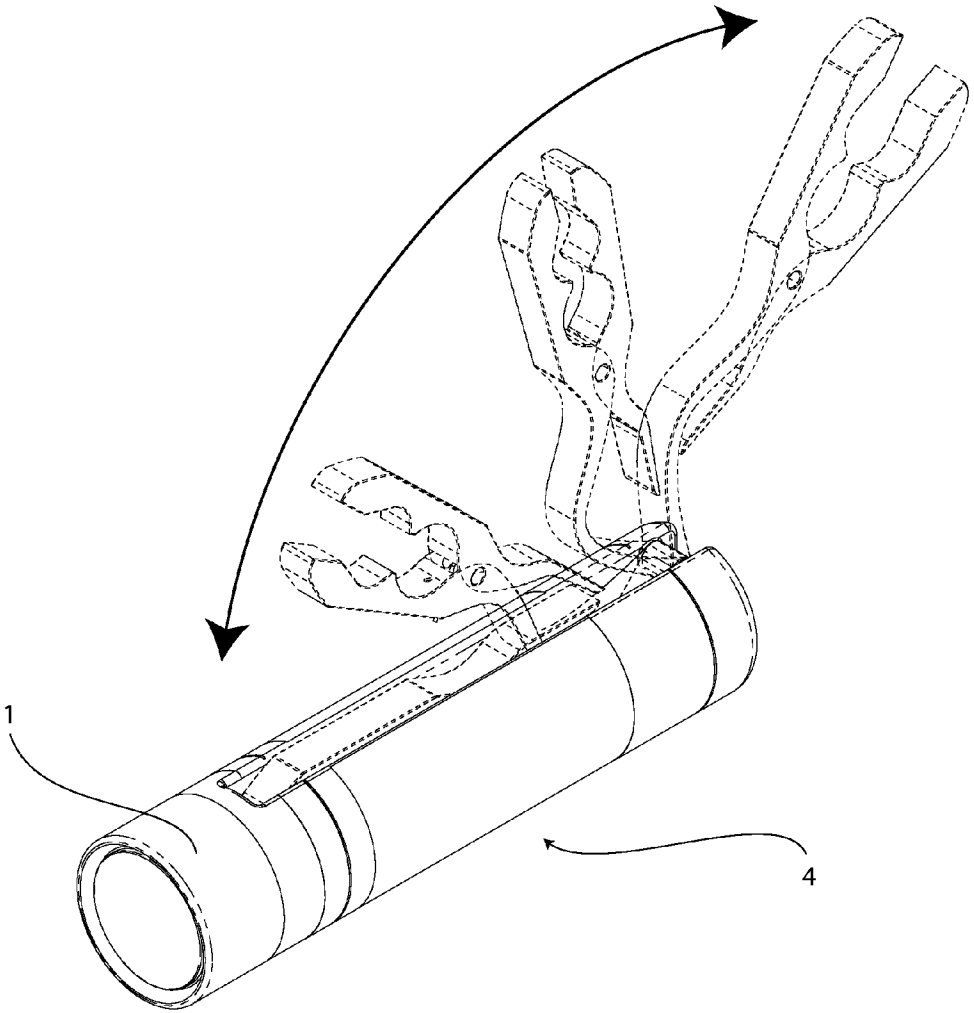
FIG. 12 is a perspective view of the present invention showing the path the clamp follows at it swivels around the rod.

In reference to FIGS. 3 and 4, only the housing component 4 is shown. The housing component 4 has a cylindrical shape and further comprises a front end 42, a back end 43, a recessed slot 41, and a plurality of battery compartments 5. The plurality of battery compartments 5 is revealed after the light emitting component 1 has been removed. The battery compartments 5 are on both sides of the recessed slot 41 and can only be accessed after the light emitting component 1 has been removed. The back end 43 of the housing component further comprises a rod 431 that runs across the recessed slot 41 to allow for the elongated handle end 401 of the first arm 31 of the clamp 3 to pivotally connect to the housing component 4 and acts as the axis of rotation. When the clamp 3 is in engaged to an object and in use, the user may adjust the flashlight to the correct angle. The pivotal connection between the elongated handle end 401 and the rod 431 on the housing component 4 has a rotational resistance high enough to resist the moment of force created by the flashlight when the clamp 3 is swiveled out and in use, but low enough to allow the user to easily swivel and adjust the clamp 3. In another embodiment, a locking mechanism is implemented within the housing component 4 and the clamp 3. The user will lock the position of the clamp 3 to ensure the flashlight remains stationary when it is deployed. The range of motion of the clamp 3 is a continuous range. The method of implementing the rod 431 on the housing component 4 can include but is not limited to running a thin, short rod perpendicularly through the back end 43 of the housing component 4, traversing through the recessed slot 41. The front end 42 of the housing component 4 further comprises a threaded end 7 that lock the light emitting component 1 to the housing component 4. The present embodiment allows triple-A batteries to be inserted into the housing component 4 with two triple-A batteries in each battery compartment 5. In reference to FIG. 5, the rear elevational view of the housing component 4 is shown with the rod 431 and the recessed slot 41 displayed. In reference to FIG. 6, the front elevational view of the housing component 4 is shown, displaying the battery compartments 5 and showing a plurality of electrical contacts 6. When placing the batteries inside the housing component 4, the batteries should stick out approximately ⅜" to have sufficient contact with the electrical contacts 6 from the light emitting component 1, the electrical contacts 6 may take on a form of a spring inside the battery compartment and will continually supply a force, pushing the batteries against the light emitting component 1 when it is attached. Each of the plurality of battery compartments 5 contain an electrical contact 6 to allow current to flow from the battery to the light bulb when the switch 2 is activated and the circuit completed. The recessed slot 41 runs along the lateral face of the housing component 4, wide enough to contain the clamp 3. In reference to FIGS. 7, 8, and 9, the light emitting component 1 is shown. The light emitting component 1 has a cylindrical shape and further comprises a threaded end 7 and an electrical contact 6. The light emitting component 1 is attached to the housing component 4 via a screw-like configuration where the user tightens and loosens the components by twisting. The light emitting component 1 contains electrical contacts 6 that touches the batteries when the light emitting component 1 is screwed onto the housing component 4. LEDs are the preferred source of light, with the housing component 4 made of lightweight materials such as but not limited to aluminum or plastic. In case the light source fails, there is an option for the present invention to replace the light source.

In the preferred embodiment, removing the light emitting component 1 from the housing component 4 allows the user to insert four triple-A batteries into the housing component 4. Two battery compartments 5, one on each side of the recessed slot 41, is designed to hold all four batteries, two in each battery compartment 5. The preferred configuration of batteries is to place them back-to-back, in series, inside the battery compartment 5. In both battery compartments 5, two triple-A batteries are inserted in such a way that the positive terminal is sticking out of the front end of the housing component 4. The electrical contacts 6 in the battery compartments 5 are in the form of a spring to receive the negative terminal of a batteries. The electrical contacts 6 on the light emitting component 1 are in the form of a square plate to receive the positive terminal of a battery. The switch 2 is located on the lateral surface of the housing component 4, near one of the electrical contacts 6. When the light emitting component 1 is screwed on, the present invention is designed so that the electrical contacts 6 complete a circuit with the triple-A batteries.

The present invention can also be carried in a small pouch made of material such as but not limited to nylon that attaches to your belt through loops in the back wall of the pouch.

Although the invention has been explained in relation to its preferred embodiment, it is to be understood that many other possible modifications and variations can be made without departing from the spirit and scope of the invention as hereinafter claimed.

What is claimed is:

1. An illumination device with integrated clamp, comprising, a light emitting component;

a switch;

a housing component;

a clamp;

a plurality of battery compartments;

the light emitting component further being cylindrical shaped and comprising a threaded end;

the housing component further being cylindrical shaped and comprising a recessed slot running along the lateral face of the housing component, a front end, and a back end;

the plurality of battery compartments being adjacently located on both sides of the recessed slot in the housing component;

the clamp being pivotally connected to the back end of the housing component and housed within the recessed slot; and the front end of the housing component being threaded to receive the threaded end of the light emitting component.

2. The illumination device with integrated clamp as claimed in claim 1, comprising, the switch being positioned on a lateral face of the light emitting component.

3. The illumination device with integrated clamp as claimed in claim 1, comprising, the clamp further comprising a first arm and a second arm and a means of pivotally connecting the first arm and the second arm; and the first arm being pivotally connected to the back of the housing component.

4. The illumination device with integrated clamp as claimed in claim 2, comprising, the first arm further comprising a grip end and an elongated handle end with the elongated handle end pivotally connecting to the back of the housing component;

the second arm further comprising a grip end and a handle end; and the first arm and second arm being pivotally connected to form a clamp-like device.

5. The illumination device with integrated clamp as claimed in claim 1, comprising, a plurality of electrical contacts being attached inside each of the battery compartments and on the light emitting component;

the battery compartment being adjacently located on both sides of the recessed slot on the housing component; and the back end of the housing component further comprising a rod that extends across the recessed slot.

6. An illumination device with integrated clamp, comprising, a light emitting component;

a switch;

a housing component;

a clamp;

a plurality of battery compartments;

a plurality of electrical contacts;

the light emitting component further being cylindrical shaped and comprising a threaded end;

the housing component further being cylindrical shaped and comprising a recessed slot running along the lateral face of the housing component, a front end, and a back end;

the plurality of battery compartments being adjacently located on both sides of the recessed slot in the housing component;

the clamp being pivotally connected to the back end of the housing component and housed within the recessed slot;

the front end of the housing component being threaded to receive the threaded end of the light emitting component;

the battery compartment being adjacently located on both sides of the recessed slot on the housing component;

the plurality of electrical contacts being attached inside the battery compartment and on the light emitting component; and the back end of the housing component further comprising a rod that extends across the recessed slot.

7. The illumination device with integrated clamp as claimed in claim 6, comprising, the switch being positioned on a lateral face of the light emitting component.

8. The illumination device with integrated clamp as claimed in claim 6, comprising, the clamp further comprising a first arm and a second arm and a means of pivotally connecting the first arm and the second arm; and the first arm being pivotally connected to the back of the rod.

9. The illumination device with integrated clamp as claimed in claim 7, comprising, the first arm further comprising a grip end and an elongated handle end with the elongated handle end pivotally connecting to the back of the housing component;

the second arm further comprising a grip end and a handle end; and the first arm and second arm being pivotally connected to form a clamp-like device.

10. An illumination device with integrated clamp, comprising, a light emitting component;

a switch;

a housing component;

a clamp;

a plurality of battery compartments;

a plurality of electrical contacts;

the switch being positioned on a lateral face of the light emitting component;

the light emitting component further being cylindrical shaped and comprising a threaded end;

the housing component further being cylindrical shaped and comprising a recessed slot running along the lateral face of the housing component, a front end, and a back end;

the plurality of battery compartments being adjacently located on both sides of the recessed slot in the housing component;

the clamp being pivotally connected to the back end of the housing component and housed within the recessed slot;

the front end of the housing component being threaded to receive the threaded end of the light emitting component;

the battery compartment being adjacently located on both sides of the recessed slot on the housing component;

the plurality of electrical contacts being attached inside the battery compartment and on the light emitting component;

the back end of the housing component further comprising a rod that extends across the recessed slot;

the clamp further comprising a first arm and a second arm and a means of pivotally connecting the first arm and the second arm;

the first arm further comprising a grip end and an elongated handle end with the elongated handle end pivotally connecting to the rod;

the second arm further comprising a grip end and a handle end; and the first arm and second arm being pivotally connected to form a clamp-like device.

* * * * *